United States Patent [19]

Marianeschi et al.

[11] 4,130,447

[45] Dec. 19, 1978

[54] ANNEALING SEPARATOR AND STEEL SHEET COATED WITH SAME

[75] Inventors: Edmondo Marianeschi; Sandro Basevi, both of Terni; Mario Barisoni, Albano Laziale (Rome); Paolo Marini; Carlo Borgianni, both of Rome; Roberto Ricci Bitti, Lanuvio (Rome), all of Italy

[73] Assignees: Centro Sperimentale Metallurgico S.p.A.; Terni-Societa per l'Industria e l'Elettricita S.p.A., both of Rome, Italy

[21] Appl. No.: 824,611

[22] Filed: Aug. 15, 1977

[30] Foreign Application Priority Data

Apr. 27, 1977 [IT] Italy ..... 49142 A/77

[51] Int. Cl.[2] ..... B23K 35/24

[52] U.S. Cl. ..... 148/27; 148/31.5; 148/31.55; 148/122; 75/152; 428/609

[58] Field of Search ..... 148/113, 27, 31.5, 122, 148/31.55, 111; 75/152; 428/609

[56] References Cited

U.S. PATENT DOCUMENTS

| | | | |
|---|---|---|---|
| 2,354,123 | 7/1944 | Horstman et al. | 148/113 |
| 2,850,381 | 9/1958 | Bolkcom et al. | 75/152 |
| 3,379,581 | 4/1968 | Kohler et al. | 148/113 |
| 3,620,645 | 11/1971 | Della Porta et al. | 422/609 |
| 3,956,029 | 5/1976 | Yamamoto et al. | 148/27 |
| 3,960,616 | 6/1976 | Evans et al. | 148/111 |

*Primary Examiner*—R. Dean
*Assistant Examiner*—John P. Sheehan
*Attorney, Agent, or Firm*—Young & Thompson

[57] ABSTRACT

An annealing separator for use on grain-oriented silicon steel strip comprises a magnesium oxide base composition containing rare earth metal oxides. The rare earth metal oxides are present in an amount of 0.8 to 30% by weight of the composition; but in the lower range of 0.8 to 5% by weight, and preferably up to 7% by weight, the oxides have a particle size of less than 325 mesh, and a fraction of 35–55% by weight smaller than 500 mesh. Alkali metal silicate may be present in an amount 5 to 45% by weight. Strip coated with annealing separator of the invention is characterized in that the coating is almost totally free of surface cavities, in that the denitriding and desulfuring rates are greatly accelerated, in that the surface resistivity of the coating is substantially increased, and in that the coating adheres more strongly to the strip.

6 Claims, 9 Drawing Figures

ANNEALING SEPARATOR AND STEEL SHEET COATED WITH SAME

The present invention relates to annealing separators; more precisely, it relates to a new composition for separating agents to be used during the annealing of grain-oriented silicon steel strip which:

(a) has a positive effect on the annealing treatment, reducing overall manufacturing process costs; and (b) improves the magnetic and electrical properties of the annealed strip.

It is a well-known fact that a very critical step in the manufacturing process of grain-oriented silicon steel strip for use as magnetic material is the final annealing treatment. The annealing treatment not only determines the selective growth of grains having a particular orientation with respect to the plane and direction of rolling, but also at the same time eliminates certain impurities from the strip (e.g. sulfides) which, although necessary during the actual process for obtaining the desired orientation of the grains, would impair the magnetic properties of the finished strip.

Said annealing treatment is usually carried out in batch-type furnaces and normally requires considerable time for completion; holding times of not less than 20 hours at soaking temperature, for example, are usual, even though some patents do provide for very much shorter annealing cycles. In this annealing the strip is loaded into the furnace in coils or, in certain cases, in packs of sheets stacked one on top of the other. This arrangement is partly responsible for the length of the annealing treatment in that it hinders free flow of the reducing atmosphere (which eliminates the sulfides) between the individual layers of the piled coils or packs. Furthermore, the individual layers of the coil or pack tend to stick together during annealing.

The annealing separators in question were introduced originally for the express purpose of eliminating these problems and consisted of refractory powders spread onto the steel strip surface before the strip was wound into coils or arranged in packs. With the passage of time, it was realized that these refractory powders could carry out additional functions other than keeping the coil layers physically apart and preventing their sticking together (thus facilitating the free flow of the reducing atmosphere), i.e.: (i) reaction with the sulfur, facilitating the elimination of this element; (ii) formation of an adhesive vitreous film capable of insulating the strip both electrically and chemically. Increasingly complex separating agents were therefore developed from the original single-component powders, such as the calcium or magnesium oxide separators described in U.S. Pat. No. 2,492,682, arriving at powders which, in addition to a magnesium oxide base, contained other compounds such as $TiO_2$, $V_2O_5$, $MnO_2$, $B_2O_3$, etc.

A factual and comprehensive picture of the progressive evolution undergone by annealing separator design is given by British Pat. Nos. 1,108,949, 1,095,903 and 1,183,092; and U.S. Pat. Nos. 3,868,280 and 3,676,227, among many others, which in addition cover separating agents with a silicate base.

At present, annealing separators are available which perform the following functions, either in whole or in part:

prevention of adhesion between individual coil layers during annealing processes in batch-type furnaces;

improvement of reducing atmosphere flow between coil layers;

reaction with sulfur that migrates from the steel strip;

formation of a protective coating on the strip;

formation of electrically insulating coatings on the strip;

formation of a coating capable of imparting a slight tension to the strip; and provision of a suitable base for subsequent electrical insulating coating.

A number of efforts have been made in various countries to improve the complex, costly and extremely lengthy manufacturing process of grain-oriented silicon steel strip as well as the ferromagnetic properties of the finished product, as can be seen from the numerous patents and the many technical papers published during the past few years.

It is accordingly an object of the present invention to reduce the length and cost of the manufacturing process and to improve some of the electrical and magnetic properties of the finished strip.

According to the present invention, it has been found that substantial improvements are possible in product quality, process length and economy when one or more rare earth oxides is added to the magnesium oxide base of the separating agent. Indeed, astonishing results can be obtained in this way, with far-reaching consequences, some of which were totally unexpected and unforeseeable in the light of available knowledge on the subject.

The improvements in question can be summarized as follows:

a noticeable positive effect on the surface roughness of the strip. Indeed, in a first instance small discontinuities were observed under the strip skin which were supposed to be inclusions. But a more complete analysis of said discontinuities led to the recognition that they were sections of small pit cavities filled with glass film. Thus the glass film controls the roughness of the strip surface;

an increase in the denitriding and desulfurizing rate, i.e. acceleration of the lengthy steps of the treatment for eliminating impurities in the strip, steps which are responsible for the extremely long annealing times normally required;

a substantially increased surface resistivity of the coating;

an increased adhesion of the coating to the strip.

The above improvements give the following practical advantages:

the absolute certainty that in every case the steel strip will benefit from the stretching effect which the coating has on the strip as the result of the different values of the coefficient of thermal expansion in strip and coating; it has in fact been ascertained that, for a given type of strip, a reduction in the skin roughness leads to increased sensitivity to stretching. The resulting tension leads in turn to extremely favorable magnetostrictive values;

a substantial reduction of the final annealing time;

the possibility in some cases of eliminating the additional coating with tensioning and insulating glass which was heretofore considered to be essential; and fewer problems during mechanical treatment of the strip.

A detailed description of the invention is given below, with specific reference to its practical application and to the accompanying drawings, in which:

FIG. 1*a* is a photomicrograph (×1000 magnification) of the cross section of the skin layer of a strip treated with an annealing separator containing MgO only.

FIG. 1*b* is a photomicrograph (×1000 magnification) of the cross section of the skin layer of a strip treated with an annealing separator according to the prior art.

FIG. 1*c* is a photomicrograph (×1000 magnification) of the cross section of the skin layer of a strip treated with an annealing separator according to the present invention.

FIG. 2 is a group of magnetostrictive curves obtained for steel strips similar to those shown in FIGS. 1*b* and 1*c*.

FIGS. 3*a* and 3*b* show hysteresis loops obtained for steel strips similar to those shown in FIGS. 1*c* and 1*b* (at 1.5 Tesla).

According to this invention, at least one compound selected from the groups listed below is added to a magnesium oxide base annealing separator:

rare earth metal oxides, e.g. ($CeO_2$, $La_2O_3$, Nd and Pr oxides, etc., and naturally-occurring minerals containing the same, e.g. monazite, bastnasite, etc.;

rare earth metal compounds which yield oxides when subjected to thermal decomposition, e.g. carbonates, phosphates, hydroxides, acetates, etc. of the rare earth metals.

In the first embodiment of the present invention the amounts added should preferably be such as to give an aggregate content of rare earths (as oxides) in the annealing separator ranging from 5% to 30% of the total weight. The composition may also have an alkali metal silicate content ranging from 5% to 45% of the total weight. The quantity of the annealing separator deposited on the strip preferably should be 6–10 g/m$^2$. The thickness of the final coating should be approximately 1–3 $\mu$m.

In order to obtain a quantitative evaluation of the improvements obtained using annealing separators designed according to this invention, longitudinal parallel strips were prepared (immediately following industrial cold rolling) from a coil of grain-oriented silicon steel strip containing 2.93% of Si. This particular method was adopted since it offered the best guarantee of test strip homogeneity.

The five narrow 400-m. long steel strips obtained in this way were each coated with one of the following separating agents:

O — MgO reference standard

A — MgO + $MnO_2$ ($MgO/MnO_2$ = 95/5) comparison sample

B — MgO + $MnO_2$ + $B_2O_3$ (0.1% as B) comparison sample

C — MgO + rare earth oxides (10% by weight)

D — MgO + rare earth oxices (10% by weight) + Na silicate (10% by weight)

In each of agents C and D, the rare earth oxides had the composition $CeO_2$: about 50%; $La_2O_3$: about 30%; Nd and Pr and other rare earth oxides: about 20%.

Figure 1A:
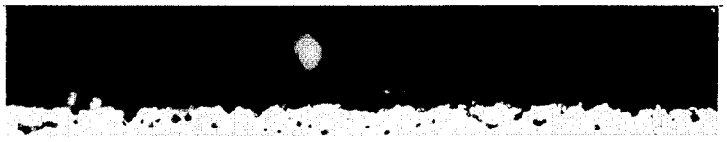

FIG. 1*a* shows a steel strip sample coated with an annealing separator containing MgO only and adopted as conventional reference standard.

Figure 1B:
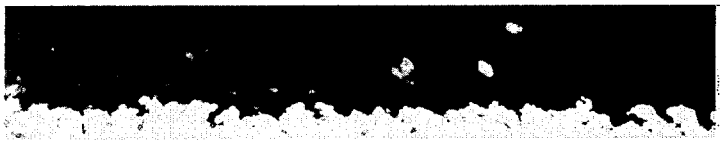
Figure 1C:
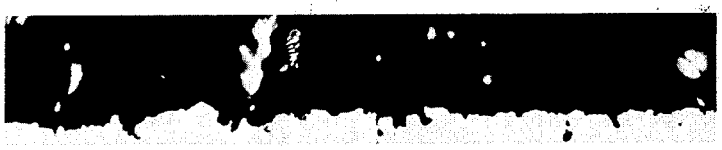

FIGS. 1*b* and 1*c* show steel strip samples coated, respectively, with separating agents A and C. The differences between the various test samples are immediately obvious from the micrographs. After examining a great many samples taken at random from the five differently coated strips, an interesting and important fact was noted: the surface roughness of the strip coated with separating agent O was fairly uniform along the entire length of the strip and more or less equal to the level shown in FIG. 1*a*, but the roughness of the strips coated with separating agents A and B varied instead to some extent, both quantitatively and by location, i.e. samples were obtained at random along the strip length which were either smoother or rougher than the sample shown in FIG. 1*b*. Finally, the strips coated with separating agents C and D gave in all cases samples which were almost totally free of surface cavities.

A review of the magnetostriction curves (FIG. 2) and of the hysteresis loops (FIGS. 3*a* and 3*b*) relative to the samples appearing in FIGS. 1*b* and 1*c* shows the influence of skin roughness on the final magnetic properties of the steel strip.

Figure 2:
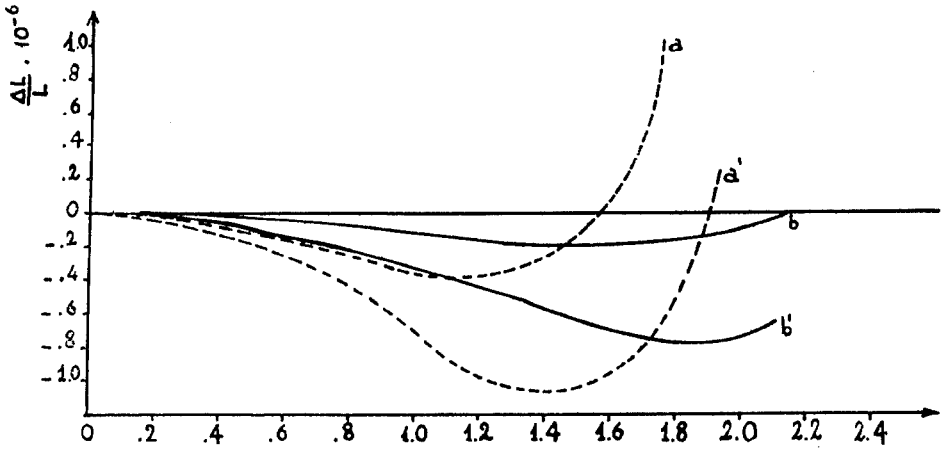

In FIG. 2, the curves a—a' and b—b' refer respectively to the strips coated with separating agents A and C. As can be seen from the curves b—b', relatively low magnetostriction values are obtained using a separating agent designed according to this invention; in addition, the magnetostriction value undergoes only a limited variation when magnetization increases from zero to maximum value during the cycle. It can also be observed that the magnetostriction curves remain at very low levels even when magnetization reaches values close to the theoretical peak value permissible for the type of steel strip in question; obviously, these conditions give a very low noise level in transformer and other magnetic cores.

Conversely, the magnetostriction curves obtained with strips coated with separating agents currently in use are very similar to those indicated in FIG. 2 by the letters a—a'. In this case, the changes produced by magnetostriction in the dimensions of the strip not only are of greater magnitude but also are far more abrupt.

Comparison between the two sets of curves shows that, for a magnetization increase from 1.2 to 1.9 Tesla, magnetostriction increases from $-0.4 \times 10^{-6}$ to much more than $1 \times 10^{-6}$ (curve a) and from approximately $-1 \times 10^{-6}$ to approximately $+3 \times 10^{-6}$ (curve a') using current-type separating agents; while only small magnetostriction variations around $-0.2 \times 10^{-6}$ (curve b) or from approximately $-0.5 \times 10^{-6}$ to approximately $-0.8 \times 10^{-6}$ (curve b') occur using annealing separators according to the present invention.

Figure 4:
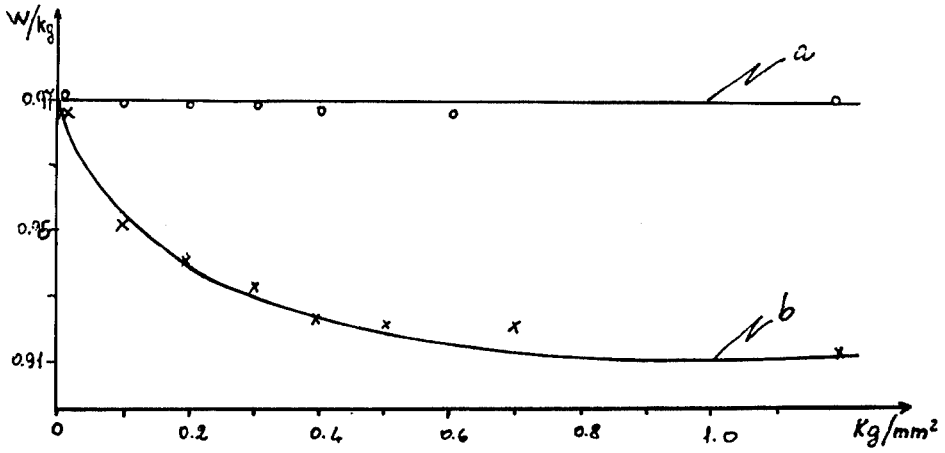
FIG. 4 is a graph showing the influence of tension on magnetic losses (at 1.5 Tesla, thickness 0.34 mm).
Figure 3A:
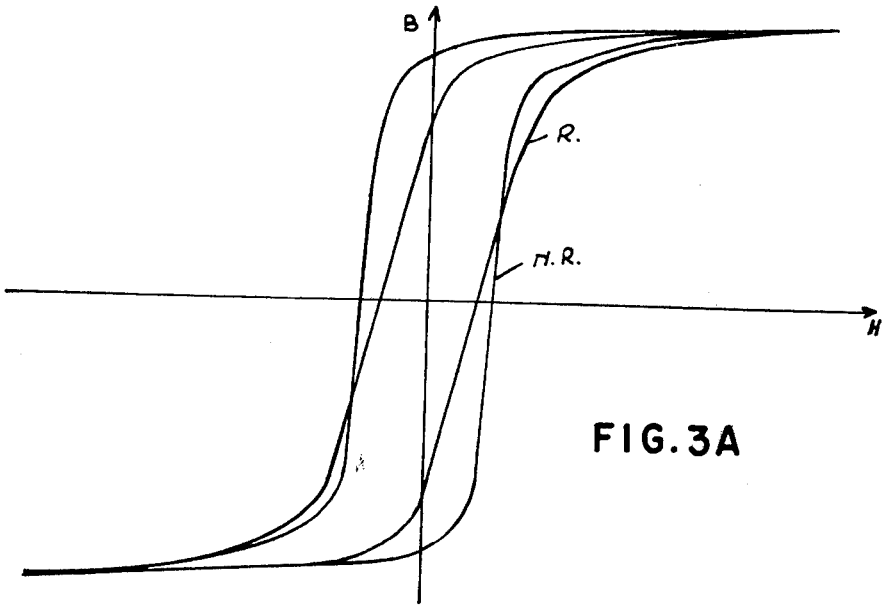
Figure 3B:
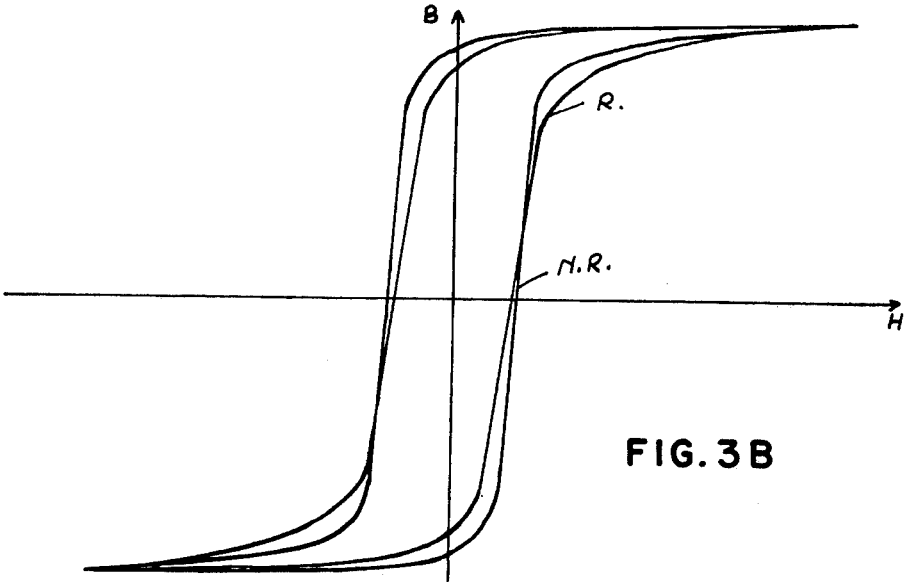

An even more convincing demonstration of the influence of skin roughness on the final magnetic properties of the steel strip is given by the diagrams reproduced in FIGS. 3*a*, 3*b* and 4. In FIGS. 3*a* and 3*b*, the hysteresis loops of strips coated with a separating agent according to this invention (FIG. 3*a*) and with separating agent A (FIG. 3*b*) are compared with the hysteresis loop of the corresponding uncoated steel strip (curves R. and N.R. in FIGS. 3*a* and 3*b*). FIG. 4 shows the influence of tension on magnetization loss for a strip of the type shown in FIG. 1*b*, both in the as-rolled condition (curve *a*) and after removal (by pickling) of the skin layer (curve *b*). As is immediately evident, the steel strip is unaffected by tension when its surface is rough, but the influence of tension is highly beneficial once roughness has been eliminated.

Figure 5:
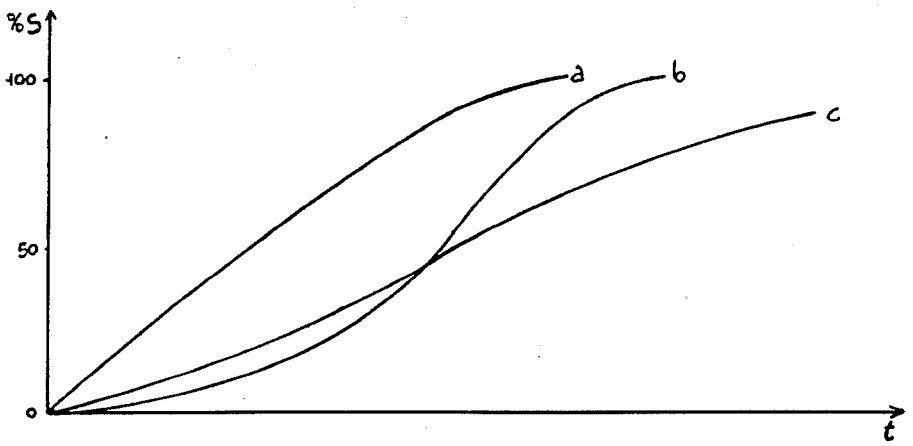
FIG. 5 shows the time rate of desulfurization.
Figure 6:
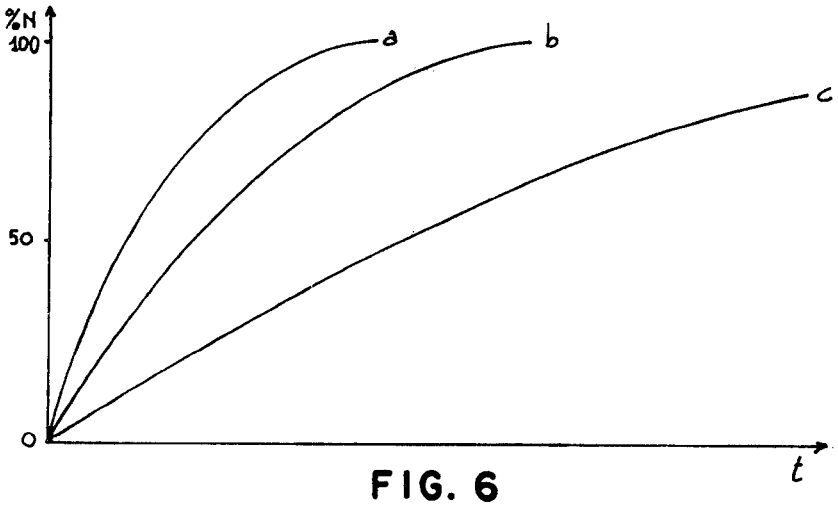
FIG. 6 shows the time rate of denitrification.

FIGS. 5 and 6 show, respectively, the desulfurization and denitrification diagrams for the uncoated steel strip (curve a), for the strip coated with separating agent A (curve c) and for the steel strip coated with separating agent C (curve b). These diagrams refer to strips which are narrower than those used industrially and cannot therefore be taken as representative of a real life situation; the diagrams have, however, been reproduced for the perfectly legitimate and valid purpose of a comparative evaluation of the curves (and therefore without any scales). It should be pointed out that industrial tests have already confirmed the validity of the curves from a qualitative standpoint.

For grain orientation, the holding time for coils at peak annealing temperature in bell-type furnaces can be reduced by the present invention by at least 15% (during some industrial tests reductions of even 50% have been obtained).

With regard to the other advantages obtainable by the use of annealing separators according to the present invention, experimental tests have established that the coating deposited by these new materials on the steel strip during conventional annealing has a far higher surface resistivity and a far greater adhesion than the coatings obtained with the separating agents currently in use. Some significant data are tabulated below for purposes of comparison relative to the five steel strips coated with separating agents O, A, B, C and D and to two commercial strips (E, F), together with values extracted from patent literature.

TABLE 1

| Separating Agents | Surface Resistivity Ω/cm² Minimum | Maximum | Average | Adhesion |
|---|---|---|---|---|
| 0 | 0.3 | 2.6 | 1.4 | >20 mm. |
| A | 2.5 | 25 | 12 | 20 mm. |
| B | 2 | 26 | 13 | 20 mm. |
| C | 35 | 200 | 110 | <5 mm. |
| D | 30 | 230 | 100 | <5 mm. |
| E | 10* | 200* | 150* | 20 mm. |
| F | 10* | 140* | 110* | 20 mm. |
| U.K. Pat. No. 1,183,092 | ~4 | >26(100*) | — | 20 mm. |
| U.S. Pat. No. 3,868,280 | 1.5 | 24 | — | >20 mm. |

* Values referring to steel strip subsequently provided with an addition coating of tensioning glass

**Data indicating the maximum diameter of rod around which steel strip can be bent at 180° without damage to, or detachment of, coating In a second embodiment of the present invention, it is also possible to use lesser amounts of rare earth metal oxides, provided they are micronized, i.e. provided the rare earth metal oxides have a particle size smaller than 325 mesh, and a fraction of 35–55% by weight smaller than 500 mesh.

In this case it is possible to use only the stoichiometric amount of rare earth metal oxides, to completely react for instance with sulfur, and even lesser amounts if the advantages connected with higher proportions of rare earth oxides (such as rapid desulfuration or denitrification) can or must be considered of minor interest.

In this embodiment the amount of rare earth metal oxides is between 0.8 and 7% in weight.

Using said lesser amounts of rare earth metal oxides, it is necessary to use an additional coating of low-melting point, insulating and tensioning glass.

However, since the glass film obtained following this second embodiment is exceptionally thin, compact and adherent, a very favorable space factor can be obtained.

A set of steel strips similar to those previously used was prepared and each strip was coated with one of the following separating agents:

(a) Rare earth metal oxides 0.8% of weight, balance essentially MgO
(b) Rare earth metal oxides 1.4% of weight, balance essentially MgO
(c) Rare earth metal oxides 2.4% of weight, balance essentially MgO
(d) Rare earth metal oxides 4.0% of weight, balance essentially MgO
(e) Rare earth metal oxides 5.6% of weight, balance essentially MgO
(f) Rare earth metal oxides 7.0% of weight, balance essentially MgO
(g) Rare earth metal oxides 10% of weight, balance essentially MgO
(h) Rare earth metal oxides 20% of weight, balance essentially MgO
(i) Rare earth metal oxides 0.4% of weight, balance essentially MgO The amount of deposited separator was between 6 and 8 g/m².

Each of said compositions was deposited using two particle sizes, i.e. smaller than 325 mesh (indicated by the relevant letter followed by 1), and between 140 and 270 mesh (indicated by the relevant letter followed by 2).

Thus a1 indicates a separating agent containing 0.8 weight % of rare earth metal oxides and having a particle size smaller than 325 mesh, balance essentially MgO; while a2 indicates the same composition of annealing separator, in which the particle size of rare earth metal oxides is between 140 and 270 mesh.

Each strip was subsequently coated with a conventional tensioning and insulating composition, and subjected to the traditional final annealings.

The most important characteristics were measured and are tabulated in the following Table 2. The Franklin resistivity was measured following ASTM A 344-60 T standard; the adhesion was measured bending the coated strip 180° around cylinders of different diameters and recording the minimum diameter down to which the inside film does not show cracks. The thickness of the strips was 0.30 mm.

In each case, the composition of the rare earth oxides was the mixture whose components and relative proportions were given above.

TABLE II

| STRIP | Glass film thickness μm | Final thickness comprising insulating layer μm | % Distribution of Franklin Resistivity 0–39,9 Ω/cm² | 40–99,9 Ω/cm² | 100–999 Ωcm² | 1000 + Ω/cm² | Adhesion ϕ mm | Permeability | Core losses W 17/50 |
|---|---|---|---|---|---|---|---|---|---|
| $a_1$ | 0.4 | 1.5 | 2 | 48 | 50 | — | 23 | 1900 | 1.11 |
| | | 3.0 | — | 25 | 60 | 15 | 18 | | 1.08 |
| $a_2$ | uneven | 2.1 | 80 | 20 | — | — | >35 | 1890 | 1.16 |
| | | 3.1 | 75 | 25 | — | — | | | 1.15 |
| $b_1$ | 0.4 | 1.6 | — | 40 | 50 | 10 | 18 | 1913 | 1.09 |
| | | 2.9 | — | 15 | 40 | 45 | 14 | | 1.05 |
| $b_2$ | uneven | 2.0 | 70 | 30 | — | — | >35 | 1905 | 1.16 |
| | | 3.5 | 70 | 20 | 10 | — | | | 1.16 |
| $e_1$ | 0.5 | 1.6 | — | 8 | 60 | 32 | 12 | 1915 | 1.09 |
| | | 3.0 | — | 4 | 40 | 56 | <10 | | 1.05 |

TABLE II-continued

| STRIP | Glass film thickness μm | Final thickness comprising insulating layer μm | % Distribution of Franklin Resistivity 0–39,9 Ω/cm² | 40–99,9 Ω/cm² | 100–999 Ωcm² | 1000 + Ω/cm² | Adhesion φ mm | Permeability | Core losses W 17/50 |
|---|---|---|---|---|---|---|---|---|---|
| $e_2$ | uneven | 2.8 | 10 | 50 | 40 | — | 20 | 1905 | 1.13 |
| | | 3.8 | — | 55 | 45 | — | 20 | | 1.13 |
| $d_1$ | 0.4 | 1.7 | — | 8 | 50 | 42 | 10 | 1917 | 1.08 |
| | | 3.1 | — | 4 | 35 | 61 | <10 | | 1.04 |
| $d_2$ | 0.4 | 1.7 | — | 25 | 65 | 120 | 15 | 1910 | 1.09 |
| | | 3.3 | — | 10 | 60 | 30 | 13 | | 1.06 |
| $e_1$ | 0.5 | 1.9 | — | 10 | 40 | 50 | <10 | 1910 | 1.10 |
| | | 3.1 | — | 8 | 45 | 47 | <10 | | 1.06 |
| $e_2$ | 0.5 | 2.0 | — | 20 | 50 | 30 | 12 | 1908 | 1.10 |
| | | 3.1 | — | 18 | 45 | 37 | 15 | | 1.08 |
| $f_1$ | 0.7 | 8.1 | — | 5 | 50 | 45 | 15 | 1906 | 1.10 |
| | | 3.6 | — | — | 50 | 50 | 12 | | 1.08 |
| $f_2$ | 0.7 | 2.1 | — | 10 | 60 | 30 | 14 | 1910 | 1.08 |
| | | 3.5 | — | 10 | 50 | 40 | 14 | | 1.06 |
| $g_1$ | 1.1 | 2.5 | — | 40 | 60 | — | 16 | 1900 | 1.12 |
| | | 3.8 | — | 40 | 50 | 10 | 13 | | 1.10 |
| $g_2$ | 0.6 | 1.9 | — | 5 | 50 | 45 | 12 | 1913 | 1.07 |
| | | 3.6 | — | — | 65 | 35 | 12 | | 1.05 |
| $h_1$ | 1.8 | 3.1 | 15 | 35 | 50 | — | 20 | 1890 | 1.16 |
| | | 4.2 | — | 35 | 60 | 5 | 15 | | 1.10 |
| $h_2$ | 0.7 | 2.1 | — | — | 60 | 40 | 12 | 1910 | 1.09 |
| | | 3.6 | — | — | 55 | 45 | 12 | | 1.07 |
| $i_1$ | Irregular | 1.3 | 30 | 45 | 25 | — | >35 | 1880 | 1.17 |
| | | 3.2 | 20 | 20 | 60 | — | 30 | | 1.17 |

In conclusion, the use of annealing separators according to this invention gives the following substantial advantages:

Almost complete elimination of pit cavities in the skin layer, guaranteeing a greater uniformity of magnetostriction values and more efficient hysteresis loops.

Possibility of reducing to a considerable extent the holding time at peak annealing temperature.

Possibility of eliminating the necessity for an additional insulating and tensioning glass coating on strips used for certain light-duty electromagnetic applications, thereby avoiding the difficult operation of applying the extra coating to the vitreous film formed on the strip during batch annealing. The technical and economic benefits resulting from this improvement can be appreciated in the data given in Table 1. Examination of these data shows that the average surface resistivity values obtained using separating agents according to the present invention are comparable (in absolute value) to those indicated currently for high-permeability silicon steel strips available on the market today with a double coating, i.e. the glass film originating from the separating agent plus the superimposed insulating and tensioning coating (for example, strips treated with the magnesium-phosphate-base separating agent marketed by Armco under the registered trademark "CARLITE").

This last-mentioned advantage leads to another advantage, equally important, i.e. the reduction of the total thickness of the finished strip, by the elimination of the need for a double coating, or by the thinness of glass film, and (since ferro-magnetic performance is unimpaired) the consequent increase in space factor by approximately 1% — a particularly interesting advantage in the case of large-size cores.

Except as indicated above, annealing times and temperatures, the particle size of the finely divided MgO, and the coating methods employed, can all be conventional.

What is claimed is:

1. Annealing separator compositions for grain-oriented silicon steel strip, said separator compositions having a magnesium oxide base and containing 0.8 to 35% by weight of at least one member selected from the group consisting of rare earth metal oxides and rare earth metal compounds which yield oxides upon heating, with the provision that when said at least one compound is present in an amount between 0.8 and 5% by weight, said compound has a particle size of less than 325 mesh, and a fraction of 35–55% by weight smaller than 500 mesh.

2. Annealing separator compositions as claimed in claim 1, with the provision that when said compound is present in an amount 0.8 to 7% by weight, said compound has a particle size of less than 325 mesh, and a fraction of 35–55% by weight smaller than 500 mesh.

3. Annealing separator compositions as claimed in claim 1, containing 5 to 45% by weight of the separator of an alkali metal silicate.

4. Annealing separator compositions as claimed in claim 1, in which said compound is present in an amount about 10% by weight, balance essentially magnesium oxide.

5. Annealing separator compositions as claimed in claim 1, in which said compound is present in an amount 10% by weight, said separator compositions containing about 10% by weight of alkali metal silicate, balance essentially magnesium oxide.

6. Grain-oriented silicon steel strip coated with an annealing separator composition as claimed in claim 1 to a thickness of about 1–3 μm.

* * * * *